US007290849B2

(12) United States Patent
Yamazaki et al.

(10) Patent No.: US 7,290,849 B2
(45) Date of Patent: Nov. 6, 2007

(54) INK JET PRINTER

(75) Inventors: Takeshi Yamazaki, Hachioji (JP); Tetsushi Aoki, Hachioji (JP); Fujio Miyamoto, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 365 days.

(21) Appl. No.: 11/101,091

(22) Filed: Apr. 7, 2005

(65) Prior Publication Data

US 2005/0231565 A1 Oct. 20, 2005

(30) Foreign Application Priority Data

Apr. 16, 2004 (JP) ..... 2004-121520

(51) Int. Cl.
*B41J 29/393* (2006.01)
*B41J 2/175* (2006.01)

(52) U.S. Cl. ..... 347/19; 347/85

(58) Field of Classification Search ..... 347/5, 347/6, 7, 19, 84, 85; 141/2, 18
See application file for complete search history.

(56) References Cited

U.S. PATENT DOCUMENTS 4,862,192 A * 8/1989 Slomianny ..... 347/7
5,373,366 A * 12/1994 Bowers ..... 356/435
5,988,791 A * 11/1999 Miyashita et al. ..... 347/43
6,036,296 A * 3/2000 Axtell et al. ..... 347/7

FOREIGN PATENT DOCUMENTS

| | | |
|---|---|---|
| JP | 59-194856 | 11/1984 |
| JP | 57-34966 | 2/1992 |
| JP | 5-220974 | 8/1993 |
| JP | 8-80619 | 3/1996 |

* cited by examiner

*Primary Examiner*—Ahn T. N. Vo
(74) *Attorney, Agent, or Firm*—Frishauf, Holtz, Goodman & Chick, P.C.

(57) ABSTRACT

An ink jet printer having: a main tank to store ink; a recording head to form an image on a recording medium by jetting the ink from a nozzle; an ink supply path to supply the ink to the recording head from the main tank; a sub tank to temporarily store the ink supplied from the main tank, the sub tank being provided in the middle of the ink supply path; an ink supply valve to control to supply or stop supplying the ink from the main tank to the sub tank by an opening or closing the ink supply valve, the ink supply valve being provided between the main tank and the sub tank on the ink supply path; and a control unit to measure a cumulative time in which the ink supply valve becomes an opened state, and estimate a remaining ink amount in the main tank.

20 Claims, 10 Drawing Sheets

INK JET PRINTER

BACKGROUND OF THE INVENTION

1. Field of the Invention

The present invention relates to an ink jet printer, and specially to an ink jet printer comprising a main tank and a sub tank as an ink tank to store ink.

2. Description of the Related Art

Various printers have been developed such as an ink jet printer, a laser printer, a thermal transfer printer, a dot impact printer, a dye sublimation printer and the like as a recording terminal connected to a word processor, a personal computer and the like. Among them, the ink jet printer has advantages such as that it is quiet compared to other types of printers and it can easily record colorful images at low cost and the like, so that the ink jet printer is popular among the printers.

The ink jet printer comprises a recording head having a plurality of nozzles for jetting ink supplied from an ink tank as a droplet, and forms an image on a recording medium based on image information by jetting the ink from each nozzle of the recording head.

Conventionally, as a detection method to detect remaining ink amount in the ink tank, one in which electrodes for detection are used and the remaining ink amount is detected from a value of resistance between the electrodes (refer to JP-Tokukaisyo-59-194856 and JP-Tokukaihei-8-80619), one in which the remaining ink amount is detected from the shape change of an ink bag (refer to JP-Tokukaisyo-57-34966), one in which the remaining ink amount is judged by detecting power variation by a section to detect temperature (refer to JP-Tokukaihei-5-220974) or the like has been known.

However, in the case of using the electrodes as described in JP-Tokukaisyo-59-194856 and JP-Tokukaihei-8-80619, the ink in the ink bag may be electrolyzed by the electrodes.

To detect the shape change of the ink bag as described in JP-Tokukaisyo-57-34966, many components have to be attached to the ink bag itself, thereby raising cost.

Further, judging the remaining ink amount by detecting temperature change as described in JP-Tokukaihei-5-220974 raises a problem of time-consuming.

Further, in the above conventional ink jet printers, the ink tank needs to be arranged lower than the recording head to create negative pressure. In the case of printing large quantities such as in the recent ink jet printer, a large capacity ink tank needs to be arranged near a platen. Thus, in the case of comprising a plurality of the ink tanks, wide width is occupied, thereby making the body of the ink jet printer extremely large.

Thus, a sub tank to create negative pressure is provided, and the ink bag (main tank) is arranged at any position, so that the area occupied by the body of the printer can be small. However, in such structure, regarding to the replacement time of the main tank, conventionally, when the ink supplied to the main tank from the sub tank runs out, the sub tank becomes the state where there is a little ink therein to cause troubles such as jet failure or the like, and then a user judges that there is no remaining ink amount in the main tank for the first time. Thus, the user knows only vague ink amount in the main tank, so that there is a problem that the replacement time cannot be specified.

SUMMARY OF THE INVENTION

The present invention is developed in view of the above described problems, and an object of the present invention is to provide an ink jet printer capable of precisely detecting remaining ink amount in a main tank without raising cost.

For solving the problems, in accordance with the first aspect of the present invention, the ink jet printer comprises:

- a main tank to store ink;
- a recording head to form an image on a recording medium by jetting the ink from a nozzle;
- an ink supply path to supply the ink to the recording head from the main tank;
- a sub tank to temporarily store the ink supplied from the main tank, the sub tank being provided in the middle of the ink supply path;
- an ink supply valve to control to supply or stop supplying the ink from the main tank to the sub tank by an opening or closing the ink supply valve, the ink supply valve being provided between the main tank and the sub tank on the ink supply path; and
- a control unit to measure a cumulative time in which the ink supply valve becomes an opened state, and estimate a remaining ink amount in the main tank.

According to the ink jet printer, because the control unit measures the cumulative time in which the ink supply valve becomes the opened state and estimates the remaining ink amount in the main tank, it is possible to precisely detect the remaining ink amount in the main tank without spending unnecessary cost.

In accordance with the second aspect of the present invention, the ink jet printer comprises:

- a main tank to store ink;
- a recording head to form an image on a recording medium by jetting the ink from a nozzle;
- an ink supply path to supply the ink to the recording head from the main tank;
- a sub tank to temporarily store the ink supplied from the main tank, the sub tank being provided in the middle of the ink supply path;
- an ink supply valve to control to supply or stop supplying the ink from the main tank to the sub tank by an opening or closing the ink supply valve, the ink supply valve being provided between the main tank and the sub tank on the ink supply path; and
- a control unit to measure a cumulative number of times of an opened state of the ink supply valve, and estimate a remaining ink amount in the main tank.

According to the ink jet printer, because the control unit measures the cumulative number of times of the opened state of the ink supply valve and estimates the remaining ink amount in the main tank, it is possible to precisely detect the remaining ink amount in the main tank without spending unnecessary cost.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

Figure 1:
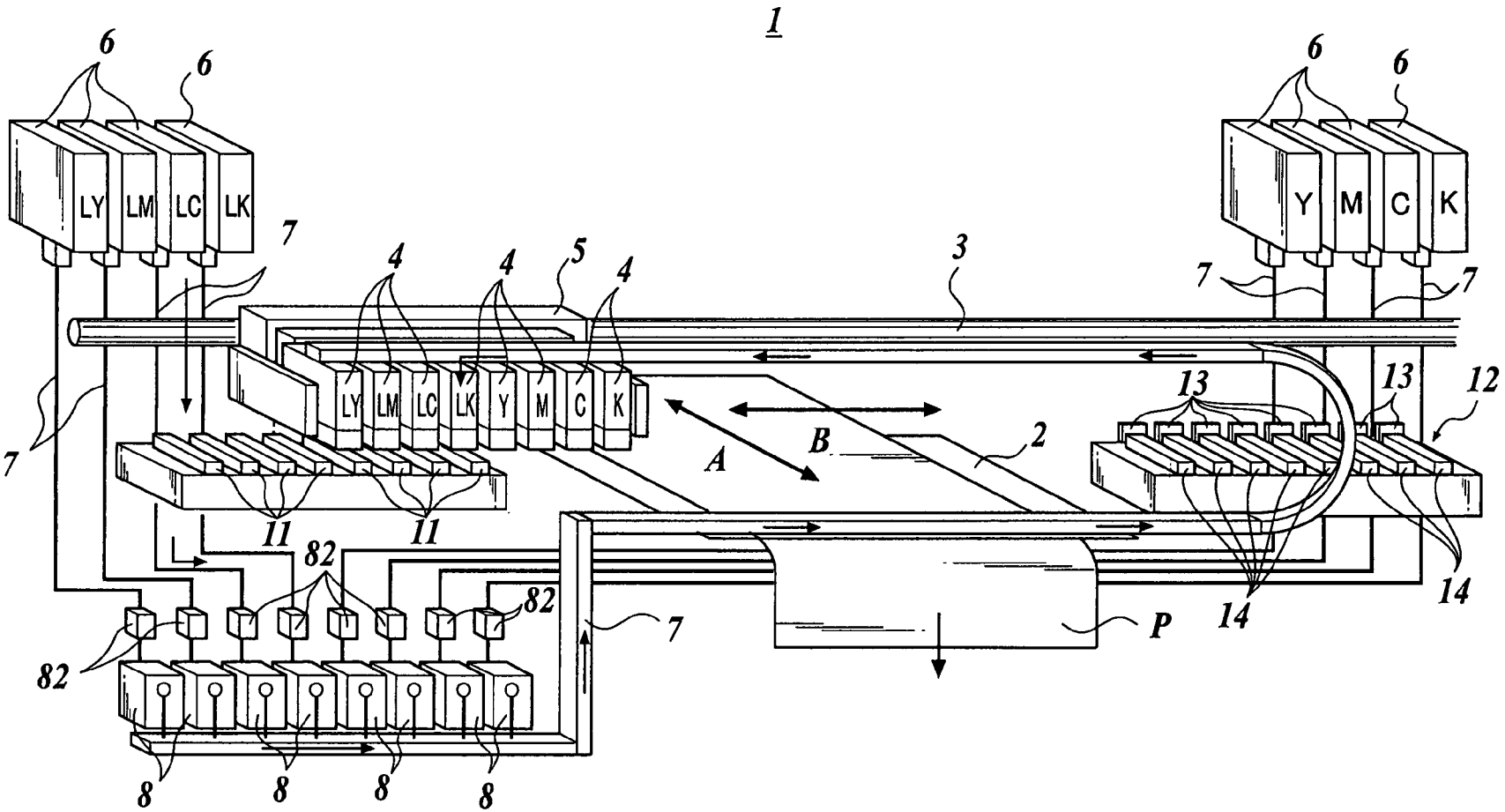
FIG. 1 is a perspective view showing a schematic structure of an ink jet printer in the embodiment.

FIG. 1 is a perspective view showing a main portion of an ink jet printer of the embodiment in which the present invention is applied.

As shown in FIG. 1, in the ink jet printer 1, a platen 2 is horizontally arranged to support a recording medium P from below. Above the platen 2, a carriage 5 to make a plurality of recording heads 4 scan along a guide rail 3 extending horizontally in a scanning direction B perpendicular to a feeding direction A of the recording medium P, is provided. The carriage 5 moves in a vertical direction to move the recording head 4 up and down.

The recording heads 4 are provided for jetting each color of ink used in the ink jet printer 1 to the recording medium P, and a plurality of nozzles for jetting ink are arranged on a nozzle-plate 41 (shown in FIG. 2) of each recording head 4. A plurality of main tanks 6 are connected to the recording heads 4 through a plurality of ink supply paths 7 for guiding ink, respectively. Each of the main tanks 6 is for storing one of the inks of light yellow (LY), light magenta (LM), light cyan (LC), light black (LK), yellow (Y), magenta (M), cyan (C) and black (K).

The main tanks 6 of the embodiment are formed with so called pouched ink pack, and can be easily replaced. A timer or a counter as a storage unit 26 is integrally provided on the main tank 6. The timer measures and memorizes a cumulative opened state time of a later described ink supply valve 82. The counter counts and memorizes the cumulative number of times of the opened state of the ink supply valve 82. As above, the storage unit is integrally provided on the main tank 6, so that, for example, when the ink pack in use is replaced with an unused ink pack and thereafter, replacing it with the ink pack in use again or the like, the used ink amount and the remaining ink amount in the ink pack (main tank 6) can be easily and properly estimated.

Figure 2:
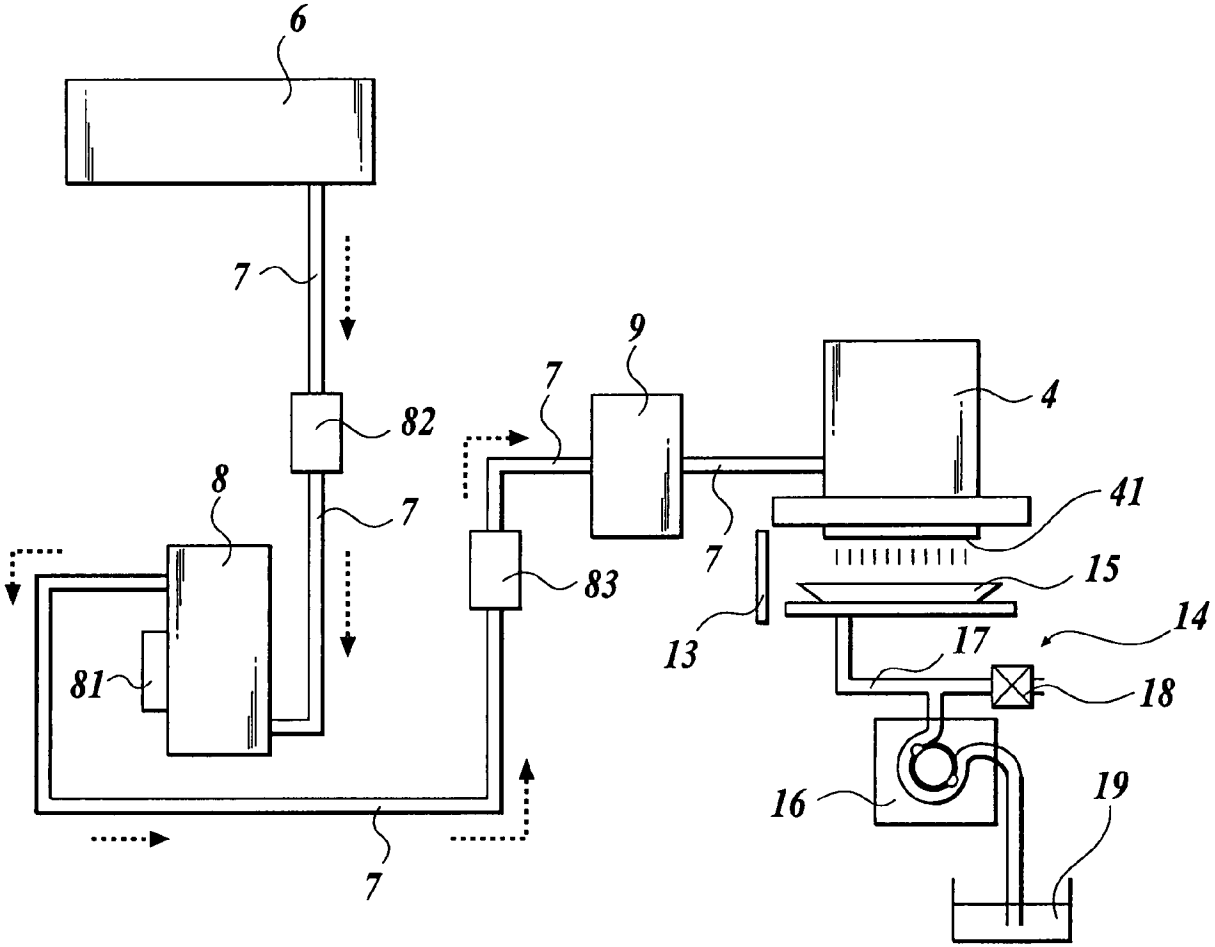
FIG. 2 is an explanation view showing an ink supplying path from a main tank to a recording head and an ink suction portion in the ink jet printer in FIG. 1.

A sub tank 8 to temporarily store the ink is provided in the middle of each ink supply path 7. As shown in FIG. 2, each sub tank 8 comprises an ink filled detection sensor 81 to detect whether the sub tank 8 is filled or not. On the upstream side of the sub tank 8, the ink supply valve 82 to adjust the ink flowing to the sub tank 8 is provided. On the other hand, on the downstream side of the sub tank 8, a pinch valve 83 to open and close the ink supply path 7 to limit the ink supply is provided. On the downstream side of the pinch valve 83, there is provided a dumper 9 to absorb the pressure fluctuation of the ink by temporarily storing the ink before the ink flowing into the recording head 4. The damper 9 is mounted on the carriage 5, and absorbs the pressure fluctuation of the ink due to the scanning of the carriage 5 or the like, thereby preventing unstable jetting of the ink.

The ink filled detection sensor 81 will be described in detail.

Figure 3A:
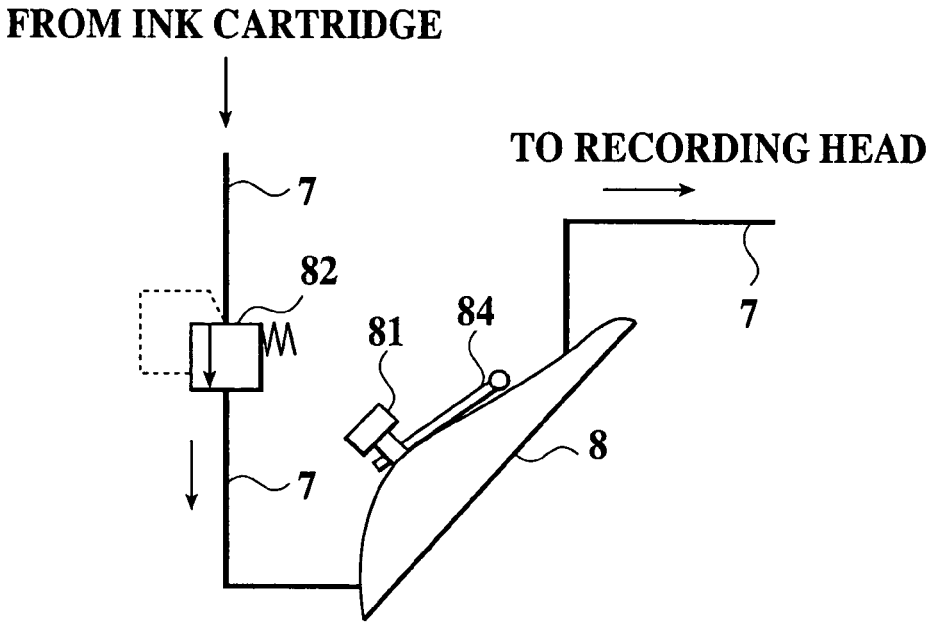
FIG. 3A is a schematic view of an ink filled detection sensor in an on-state.
Figure 3B:
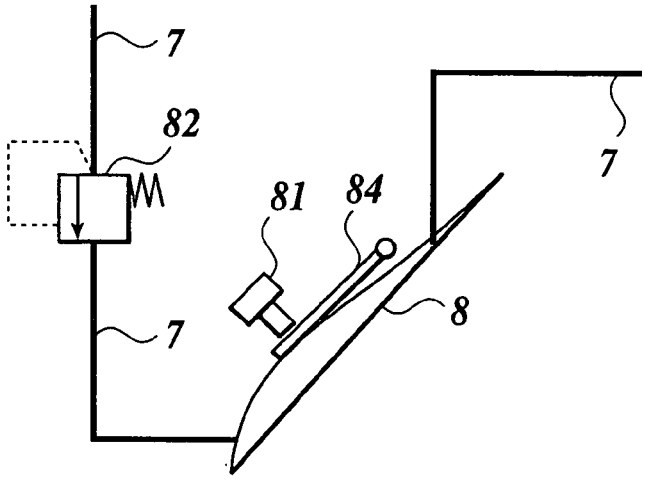
FIG. 3B is a schematic view of the ink filled detection sensor in an off-state.

As shown in FIG. 3A, the ink filled detection sensor 81 comprises a photo sensor. When the sub tank 8 composed of a flexible container expands due to the ink supplied from the main tank 6, the sub tank 8 pushes up an actuator 84 to turn the ink filled detection sensor 81 on. When the actuator 84 goes down with the ink decreases as shown in FIG. 3B, the ink filled detection sensor 81 is adapted to be turned off. This signal is transmitted to a control unit 20, so that the control unit 20 performs opening and closing of the ink supply valve 82.

As shown in FIG. 1, on one side of the platen 2, there is provided a plurality of moisture retaining caps 11 to retain the moisture state of the nozzles by covering the nozzle-plates 41 of the recording heads 4 when the recording heads 4 are on standby. On the other hand, a cleaning unit 12 to clean the recording heads 4 is provided on the other side of the platen 2.

The cleaning unit 12 is provided with flexible wipes 13 extending upward. The cleaning unit 12 itself is moved horizontally (approximately back and forth direction in FIG. 1 in the embodiment) in the state where the wipes 13 contact the nozzle-plates 41 of the recording heads 4, so that the wipes 13 slide in the contact state to remove the ink, dust or the like adhered to the nozzle-plates 41.

Ink suction units 14 to suction the ink in the nozzles of the recording heads 4 are provided in the cleaning unit 12. As shown in FIG. 2, each nozzle-plate 14 is provided with a suction cap 15 which contacts or is separated from the nozzle-plate 41 of the recording head 4 according to the up and down movement of the carriage 5. When sucking the ink in the nozzles, the suction cap 15 is moved to closely contact the nozzle-plate 41 with the downward movement of the carriage 5, and all nozzles of the nozzle-plate 41 are covered to suction the ink. When the suction is completed, the suction cap 15 is separated from the nozzle-plate 41 with the upward movement of the carriage 5. Connected to the suction cap 15 through a waste ink path 17 is a suction pump 16 to suction the inside space between the suction cap 15 and the nozzle-plate 41 when the suction cap 15 contacts the nozzle-plate 41. An air communication valve 18 to make the air communicated with the waste ink path 17 is connected to the waste ink path 17 between the suction cap 15 and the suction pump 16. On the most downstream side of the waste ink path 17, there is provided a waste ink tank 19 to store discharged wasted ink.

Figure 4:
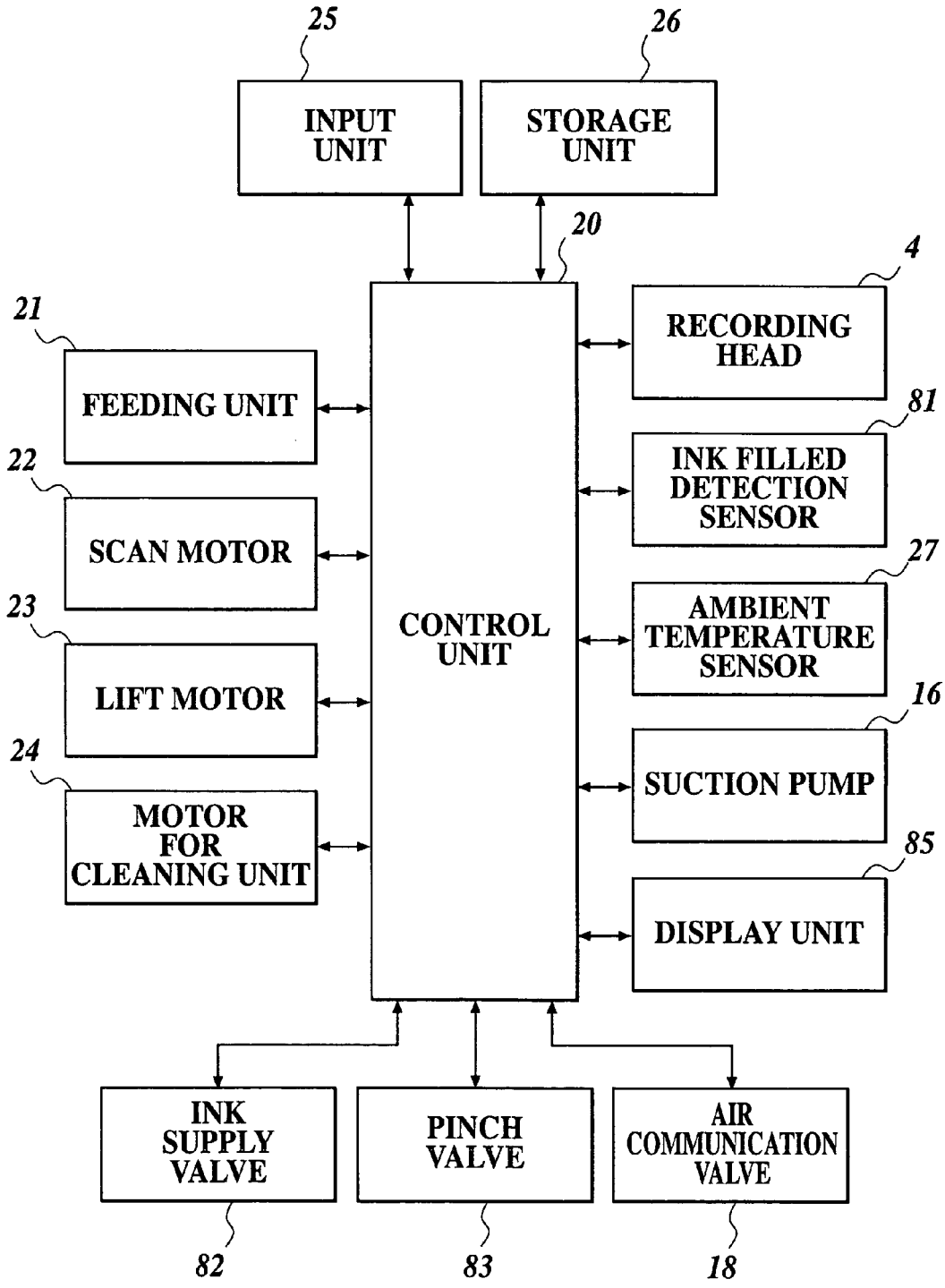
FIG. 4 is a block diagram showing a main control structure of the ink jet printer in FIG. 1.

FIG. 4 is a block diagram showing a main control structure of the ink jet printer 1. As shown in FIG. 4, the ink jet printer 1 is provided with the control unit 20 to control each drive unit. Electrically connected to the control unit 20 are a feeding unit 21 to feed the recording medium P along the feeding direction A, a scan motor 22 to make the carriage 5 perform scanning, a lift motor 23 to move the carriage 5 up and down, a motor for cleaning unit 24 to move the cleaning unit 12 in the horizontal direction, an input unit 25 to input various instructions such as an image recording start instruction or the like, the ink supply valves 82, the pinch valves 83, the air communication valves 18, the suction pumps 16, the ink filled detection sensors 81, an ambient temperature sensor 27, the recording heads 4, the storage unit 26, and a display unit 85 to display various information such as the estimated value of the remaining ink amount estimating the remaining ink amount in the main tank 6. The display unit 85 in the embodiment doubles as an alarm unit to give an alarm that there is no ink in the main tank in the case where the estimated value of the remaining ink amount in the main tank is not more than the predetermined value. Further, the display unit 85 doubles as an alarm section to give an alarm in the case where an ink empty detection section which is separate from the above structure detects that there is no ink. A display device such as LCD or the like is cited as the display unit 85. It may be such that each of the display unit, the alarm unit and the alarm section has a different structure. Further, the alarm unit and the alarm section may have an auditory structure, or a visual structure.

Each drive unit of the ink jet printer 1 is also connected to the control unit 20 other than the above units.

Moreover, the control unit 20 is provided with a measuring unit to measure the cumulative time or the cumulative number of times of the opened state of the ink supply valve 82.

The control unit 20 controls each device according to the control program or the control data written in the storage unit 26.

Next, the operation when forming an image by the ink jet printer 1 will be explained.

When the image recording is started, an operator inputs the image recording start instruction.

The control unit 20 controls the feeding unit 21 with the input of the image recording start instruction to intermittently feed the recording medium P in the feeding direction A. When the recording medium P is stopped during feeding, the control unit 20 controls the scan motor 22 to make the carriage 5 scan in the main scanning direction B. The control unit 20 controls the recording heads 4 based on the image data corresponding to the scanning to jet ink on the recording medium P, thereby recording an image.

Figure 5:
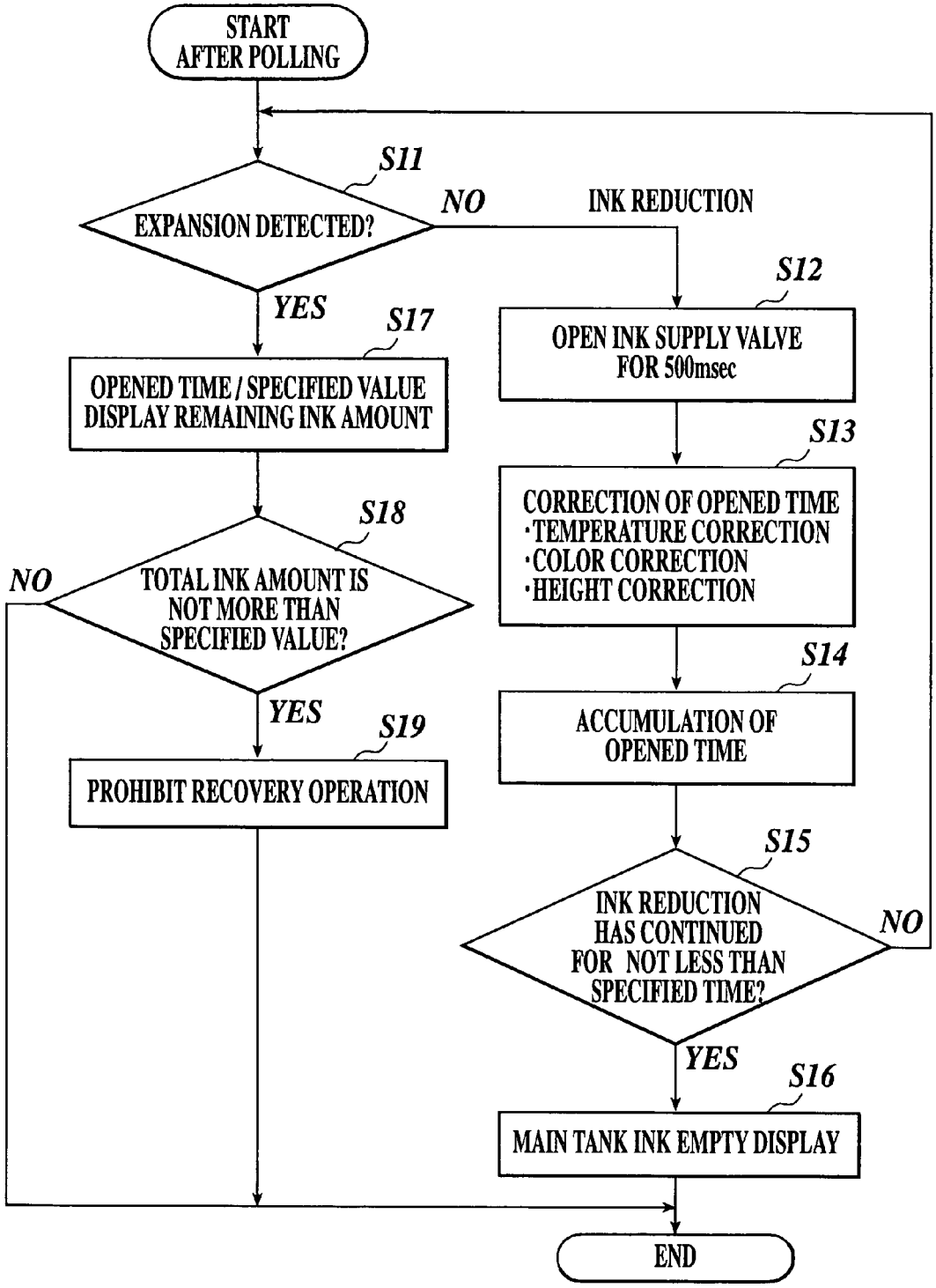
FIG. 5 is a flow chart in a case of estimating a remaining ink amount in the main tank by measuring a cumulative opened state time of an ink supply valve.
Figure 7:
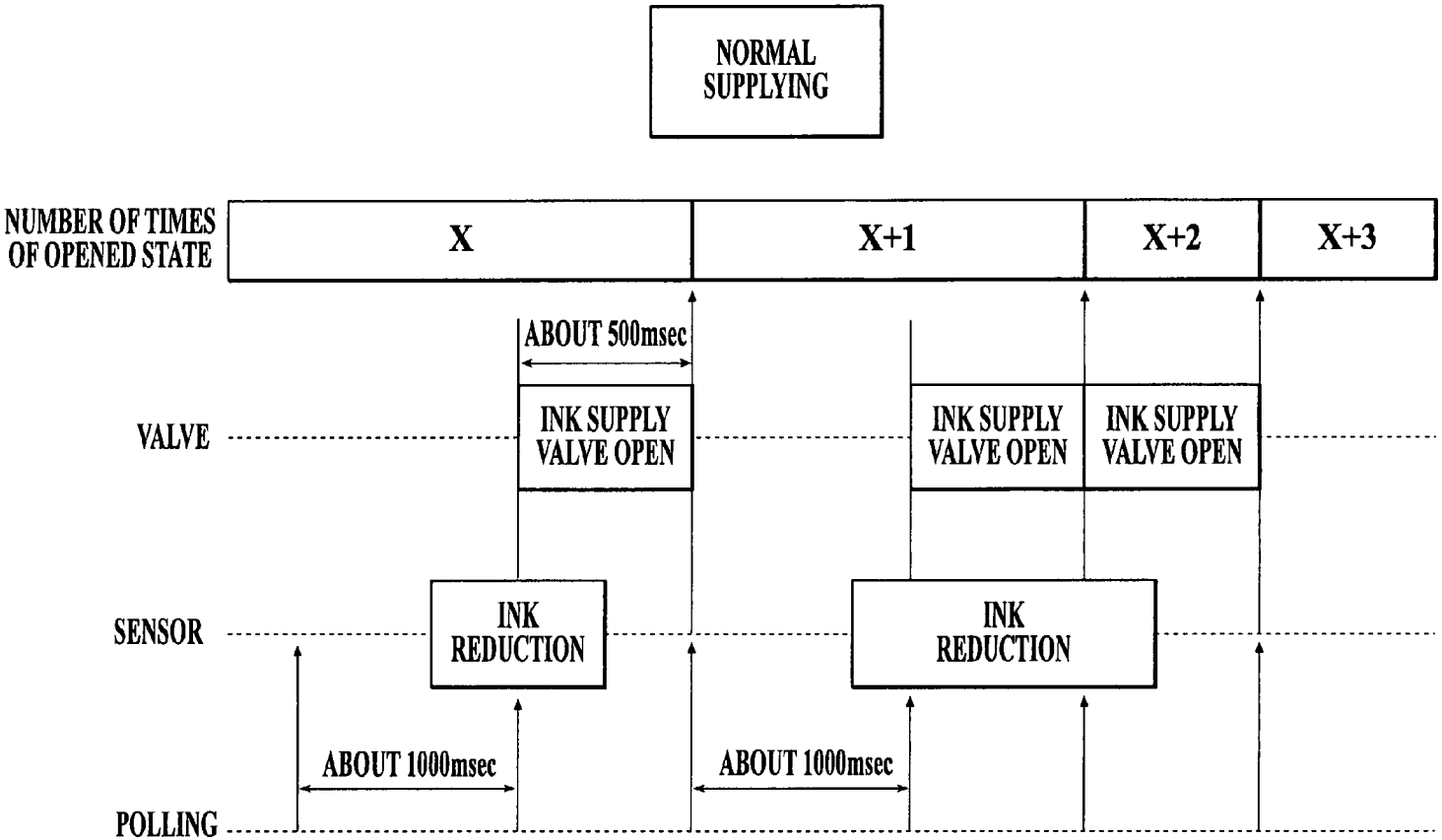
FIG. 7 is a timing chart of the ink supply valve in a case of normally supplying ink.
Figure 8:
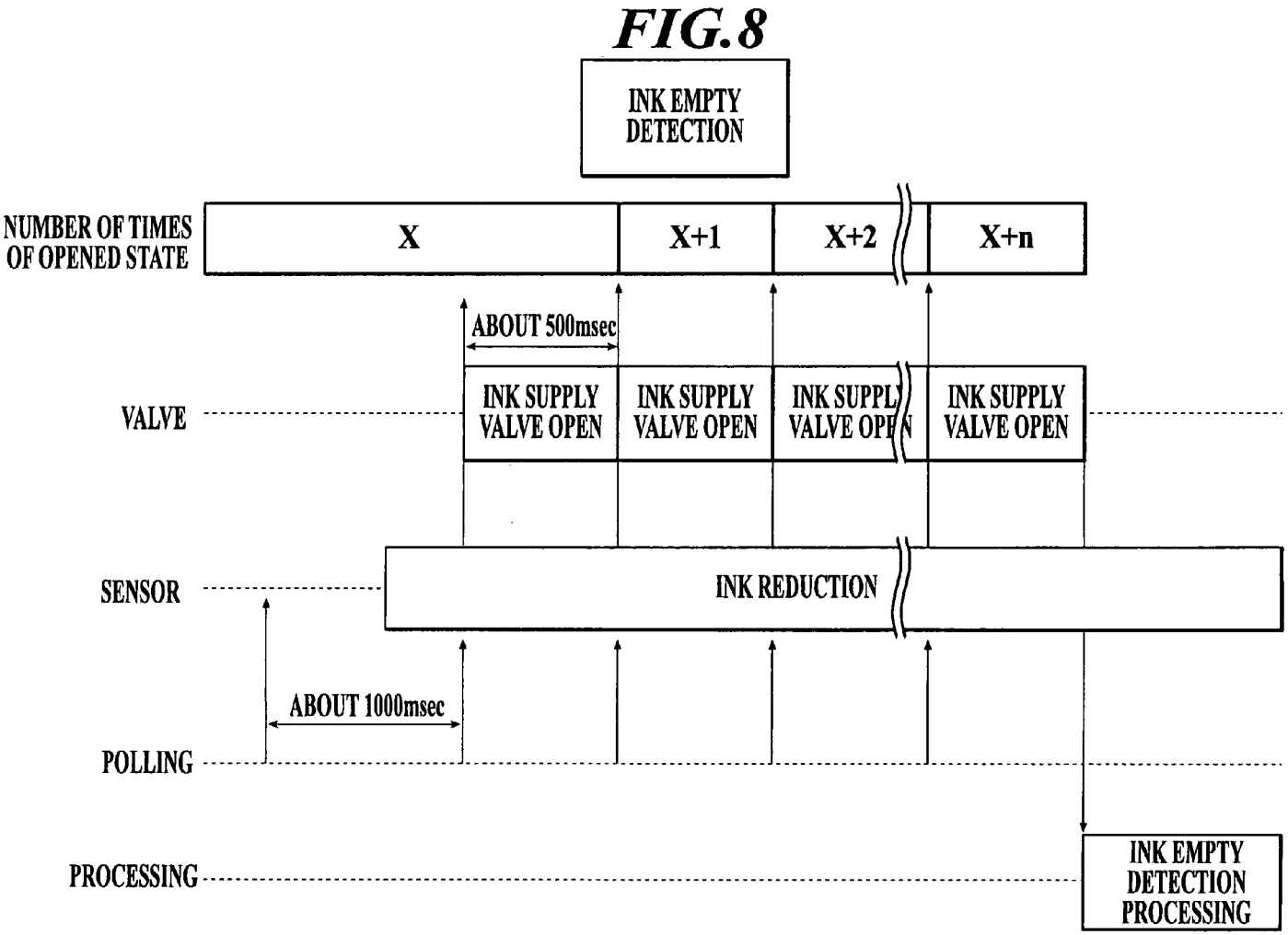
FIG. 8 is a timing chart of the ink supply valve in a case of detecting that there is no ink.

Also, the control unit 20 performs monitoring at a constant frequency so that the sub tanks 8 always retain a certain amount of ink therein. An explanation will be made below referring to the flow chart in FIG. 5 and the timing charts in FIGS. 7 and 8.

First, a judgment is made whether the sub tank 8 has expanded or not, that is, whether the ink filled detection sensor 81 is on or off (Step S11).

When the sub tank 8 has not expanded and the sensor is off, the ink supply valve 82 becomes the opened state for 500 msec (Step S12), the correction of the opened state time is performed according to the type of the ink, the ambient temperature detected by the ambient temperature sensor 27, color, difference of elevation between the main tank 6 and the sub tank 8 and the like (Step S13), and the opened state time is accumulated to measure the cumulative opened state time (Step S14). Thereafter, the judgment is made whether the ink reduction state has continued for not less than the specified time (10 sec in the embodiment) or not (Step S15). In the case where the ink reduction state has continued for 10 sec or more, the judgment is made that there is no ink in the main tank, and a main tank empty display is performed on the display unit 85 as the alarm section (Step S16).

In the Step 11, in the case where the sub tank 8 is expanded and the ink filled detection sensor 81 is on, the calculation, that is, (the cumulative opened state time of the ink supply valve)/(specified value), is performed to estimate the remaining ink amount in the main tank 6 and display the remaining ink amount (Step S17). Then, the judgment is made whether the total amount (ink amount) is not more than the specified value or not (Step 18) When the total amount is not more than the specified value, the head cleaning operation is controlled to be prohibited (Step S19).

This operation is repeated every certain period of time.

The correction method of the opened state time according to the type of the ink, ambient temperature, color, difference of elevation between the main tank 6 and the sub tank 8 and the like is performed as follows.

In the case where the time to open the ink supply valve to make the main tank 6 communicate with the sub tank 8 (the opened time of the ink supply valve) is set to 500 msec as in the embodiment, the correction is made as follows. First, basically, the amount of the ink droppage is determined by the height (difference of elevation) from the main tank 6 to the sub tank 8, and is expressed by the following equation.

$$Q=kA^2gh \qquad \text{[Equation 1]}$$

where, Q: flow rate per unit time, A: cross-section area, g: acceleration due to gravity, h: height, k: constant.

Therefore, the height of the liquid surface changes when the remaining ink amount in the main tank 6 reduces, so that the correction is made according to the height of the liquid surface. In the case where the same color of ink is supplied from a plurality of the main tanks 6, the correction is also made although the plurality of the main tanks 6 may be superposed.

(500 msec)×(correction coefficient of height)=(opened state corresponding time 1)

Figure 9:
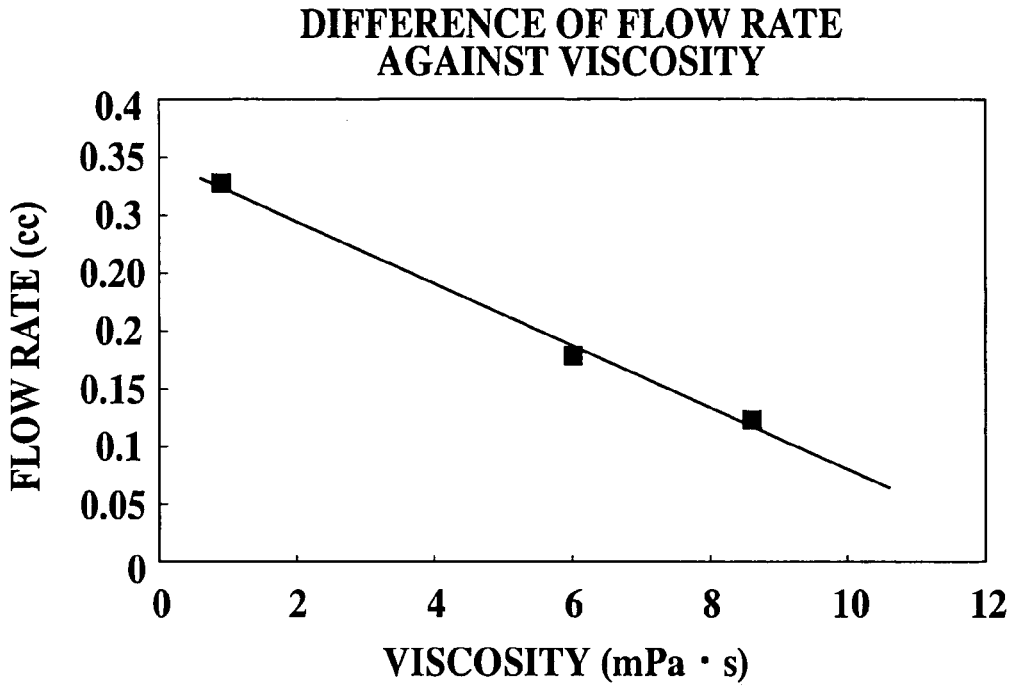
FIG. 9 is a graph showing a difference of ink flow rate against viscosity.
Figure 10:
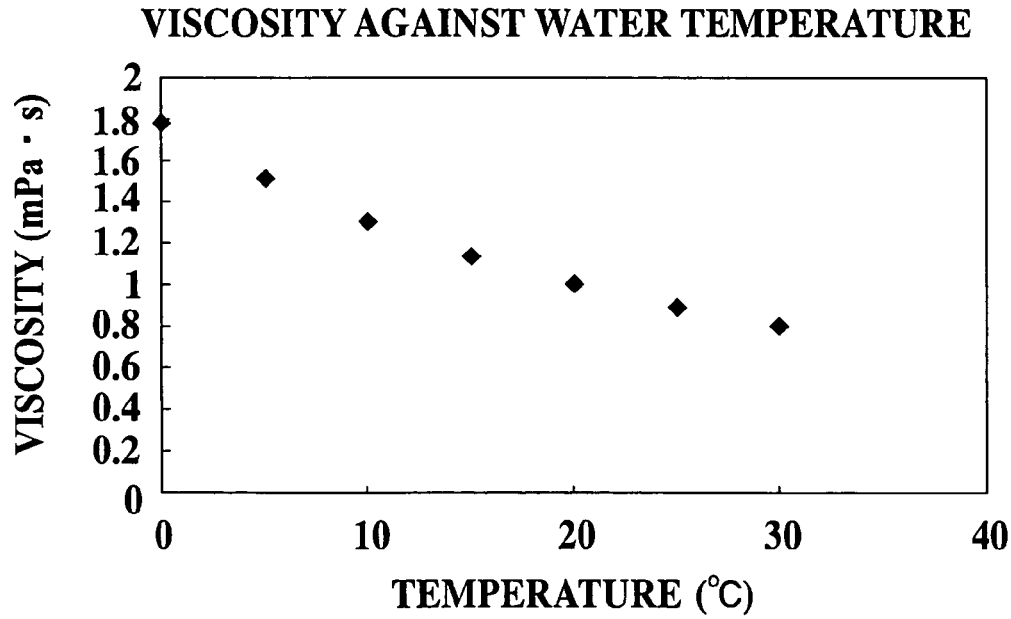
FIG. 10 is a graph showing a difference of viscosity against water temperature.

Also, the correction is made according to the difference in viscosity depending upon color, color density and the type of the ink. As shown in FIG. 9, because the flow rate changes, the correction accompanying thereto is performed.

(opened state corresponding time 1)×(correction coefficient of viscosity)=(opened state corresponding time 2)

Further, the correction according to the ambient temperature detected by the ambient temperature sensor 27 is performed. As shown in FIG. 1, because the viscosity changes according to the temperature, the correction accompanying thereto is performed.

(opened state corresponding time 2)×(correction coefficient of temperature)=(opened state corresponding time 3)

The opened state corresponding time 3 is accumulated to be the cumulative opened state time to estimate the remaining ink amount in the main tank 6.

The estimation method of the remaining ink amount is performed as follows.

(1−(cumulative opened state time after attaching ink pack (main tank))/(specified time)×100=(remaining ink amount %)

In the embodiment, the remaining ink amount is expressed in percentage (%), however it is not limited thereto. For example, it may be expressed in 3 or 5 levels each having a range of a certain value.

Figure 6:
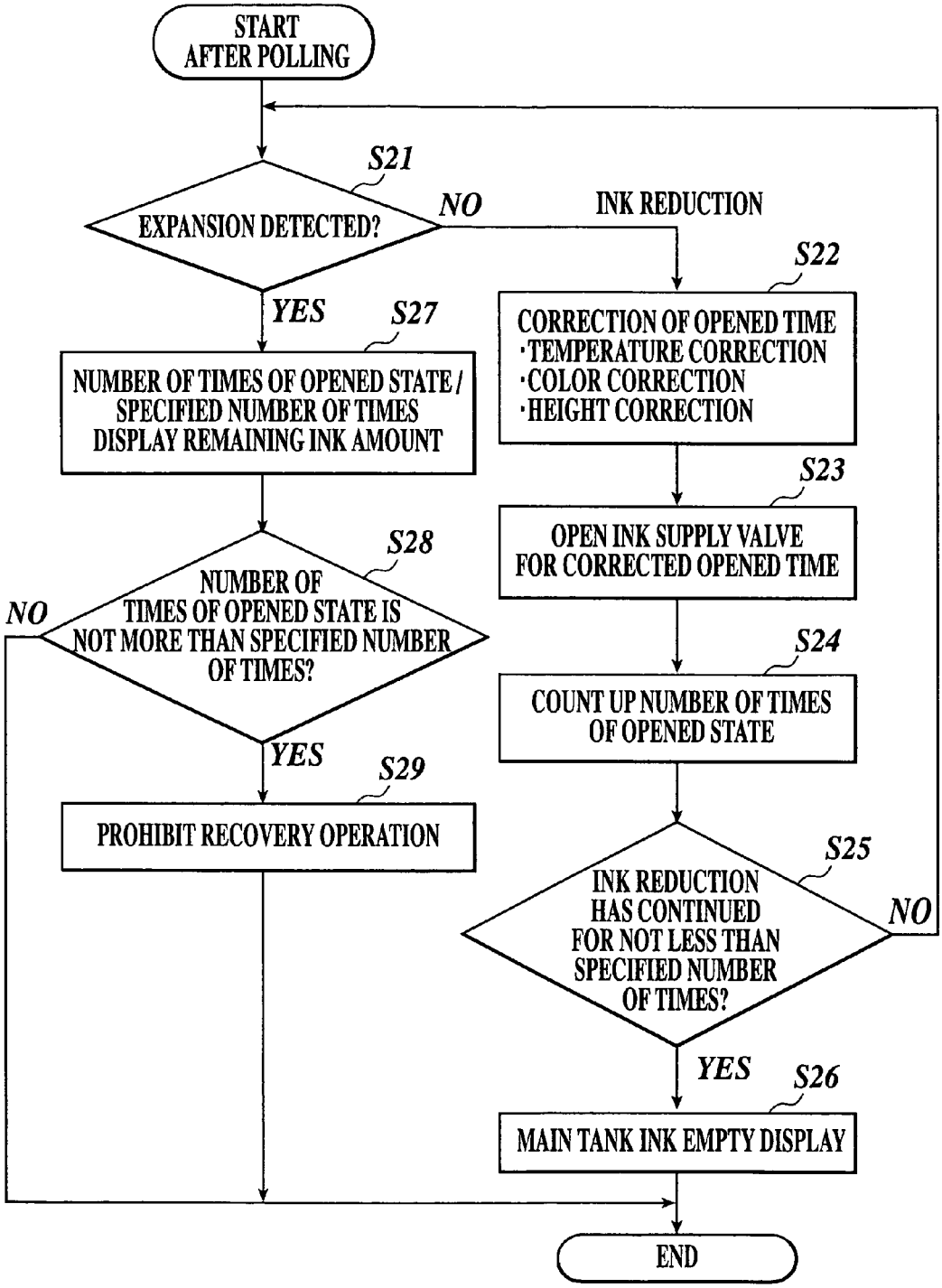
FIG. 6 is a flow chart in a case of estimating the remaining ink amount in the main tank by measuring the cumulative number of times of the opened state of the ink supply valve.

Next, another example of the monitoring control performed by the control unit 20 at a constant frequency so as to always maintain a certain amount of ink in the sub tank 8 will be explained referring to the flow chart in FIG. 6.

First, a judgment is made whether the sub tank 8 has expanded or not, that is, whether the ink filled detection sensor 81 is on or off (Step S21).

When the sub tank 8 has not expanded and the sensor is off, the correction of the opened state time is performed according to the type of the ink, the ambient temperature, color, difference of elevation between the main tank 6 and the sub tank 8 and the like (Step S22), the ink supply valve 82 becomes the opened state during the corrected opened state time (Step S23), and one is added to the number of times of the opened state (Step S24). Thereafter, the judgment is made whether the ink reduction state has continued not less than the specified times (10 times in the embodiment) or not (Step S25). In the case where the ink reduction state has continued not less than 10 times, the judgment is made that there is not ink in the main tank, and a main tank empty display is performed on the display unit 85 (Step S26).

In the Step 21, in the case where the sub tank 8 is expanded and the ink filled detection sensor 81 is on, the calculation, that is, (the cumulative number of times of the opened state of the ink supply valve)/(specified value), is performed to estimate the remaining ink amount in the main tank 6 and display the remaining ink amount (Step S27). Then, the judgment is made whether the cumulative number of times of the opened state (ink amount) is not less than the specified times or not (Step 28). When the cumulative number of times of the opened state is not less than the specified times, the head cleaning operation is controlled to be prohibited (Step S29).

This operation is repeated every certain period of time.

The correction method of the time of the opened state according to the type of the ink, ambient temperature, color, difference of elevation between the main tank 6 and the sub tank 8 and the like is performed as described above.

The amount of the ink supply is estimated from the total (the cumulative number of times of the opened state) of the number of times of the opened state (the number of times of the opened state of the ink supply valve).

The estimation method of the remaining ink amount is performed as follows.

(1−(cumulative number of times of the opened state after attaching ink pack(main tank)/(specified number of times)×100=(remaining ink amount%)

Figure 11:
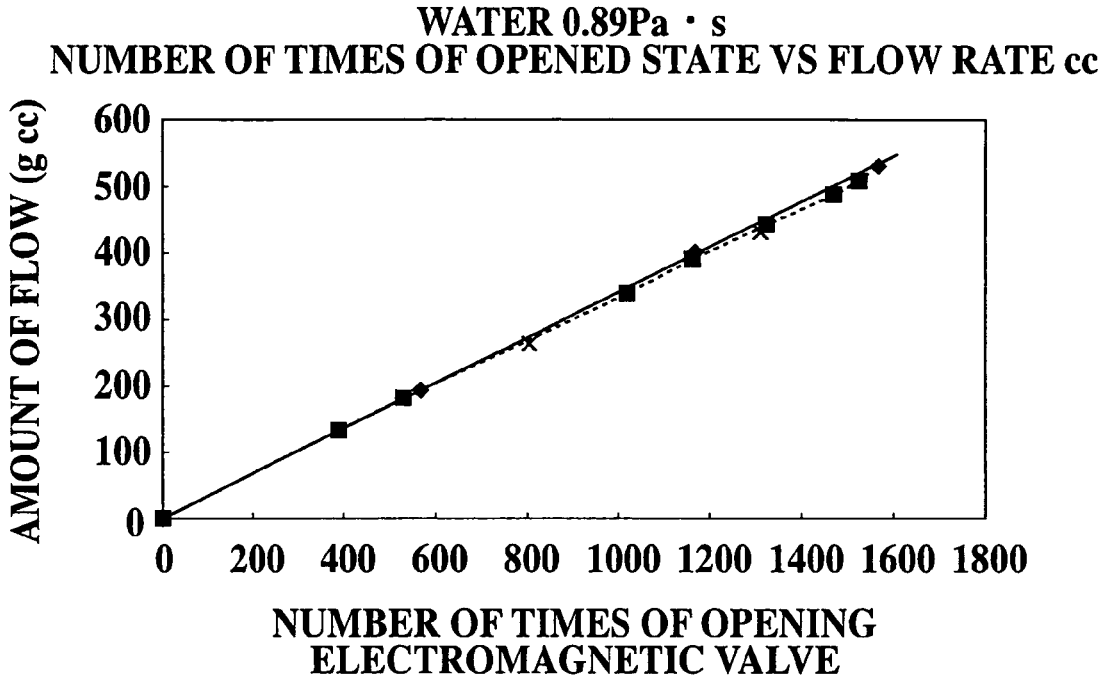
FIG. 11 is a graph showing a relation between the cumulative number of times of the opened state by the flow chart in FIG. 6 and the ink amount of flow.

In the embodiment, as shown in FIG. 11, in the case where the ink amount is 500 cc, the viscosity of the ink is 6 mPa·s, and the height from the main tank 6 to the sub tank 8 is 500 mm, when the cumulative opened state time is 700 sec (500 msec×about 1400 times), the main tank becomes empty.

In the embodiment, the main tank empty detection and the remaining ink detection are separately performed, however, it is not limited thereto. It may be such that when it was detected in the remaining ink detection that the predetermined amount of ink was consumed, alarming of "empty" or "almost empty" is provided to prohibit printing operating.

It may be such that the remaining ink amount of the ink pack is registered to the main body by adding a number of a semiconductor memory, an identification number, a bar code or the like to the main tank, so that the ink supply valve does not open when a wrong ink pack is set in the main tank. By memorizing not only the identification number but also the remaining ink amount in the memory of the main body at the same time, the ink pack in use can be used again.

As described above, according to the ink jet printer 1 of the embodiment, since the control unit measures the cumulative opened state time of the ink supply valve to estimate the remaining ink amount in the main tank, it is possible to precisely detect the remaining ink amount in the main tank without spending unnecessary cost.

In the embodiment, the storage device to store the cumulative opened state time of the ink supply valve is integrally formed with the main tank, so that it is possible to easily and certainly estimate the ink amount which was used and remaining ink amount in the main tank in the case where the ink pack as the main tank in use is replaced with another one and then, replacing it with the ink pack in use again.

Further, in the embodiment, the control unit sets the period of one time in which the ink supply valve becomes the opened state to allow the predetermined ink amount to pass the ink supply valve from the time in which the ink supply valve is opened to the time in which the ink supply valve is closed, and estimates the remaining ink amount in the main tank by measuring the cumulative number of times of the opened state of the ink supply valve. Thus, precise detection of the remaining ink amount in the main tank can be achieved without spending unnecessary cost.

Further, in the embodiment, the storage device to store the cumulative number of times of the opened state of the ink supply valve is integrally formed with the main tank, so that it is possible to easily and certainly estimate the ink amount which was used and remaining ink amount in the main tank in the case where the ink pack as the main tank in use is replaced with another one and then, replacing it with the ink pack in use again.

Further, in the embodiment, when the ambient temperature changes, the period of one time in which the ink supply valve becomes the opened state is corrected to allow the predetermined ink amount to pass the ink supply valve from the time in which the ink supply valve is opened to the time in which the ink supply valve is closed. Thus, more precise detection of the remaining ink amount can be performed.

Further, in the embodiment, the estimated value of the remaining ink amount in the main tank is calculated by the equation of ((initial value)−Σ((opened time of the ink supply valve)×(coefficient)), so that more precise detection of the remaining ink amount can be performed.

Further, in the embodiment, the control unit corrects the time in which the ink supply valve becomes the opened state according to the ambient temperature and accumulates it when calculating the estimated value of the remaining ink amount in the main tank, so that more precise detection of the remaining ink amount can be performed.

Further, in the embodiment, the control unit calculates the estimated value of the remaining ink amount from the equation of ((initial value)−Σ((opened number of times of the ink supply valve)×(coefficient)), so that more precise detection of the remaining ink amount can be performed.

Further, in the embodiment, a plurality of main tanks storing ink with different viscosities are provided, and the control unit sets a different coefficient according to the viscosity of each ink when calculating the estimated value of the remaining ink amount in the main tank, so that more precise detection of the remaining ink amount can be performed.

Further, in the embodiment, a plurality of main tanks storing ink with different colors and/or color densities are provided, and the control unit sets a different coefficient according to the color and/or the color density of each ink when calculating the estimated value of the remaining ink amount in the main tank, so that more precise detection of the remaining ink amount can be performed.

Further, in the embodiment, the main tank is provided at the higher position of the sub tank, and the control unit sets coefficients according to the difference of elevation of the main tank and the sub tank when calculating the estimated value of the remaining ink amount in the main tank, so that more precise detection of the remaining ink amount can be performed.

Further, in the embodiment, the display unit to display the estimated value of the remaining ink amount in the main tank is provided, so that a user can easily check the remaining ink amount.

Further, in the embodiment, the control to prohibit the head cleaning is performed when the estimated value of the remaining ink amount in the main tank is not more than the predetermined value, so that it is prevented to consume unnecessary ink when there is a little ink.

Further, in the embodiment, the alarm unit to give an alarm that there is no ink in the main tank is provided to give an alarm when the estimated value of the remaining ink amount in the main tank is not more than the predetermined value, so that a user can easily notice the time to replace the ink.

Further, in the embodiment, the ink empty detection section to detect that there is no ink in the main tank and the alarm section to give an alarm in the case when the ink empty detection section detects that there is no ink in the main tank are provided to be separate from the structure for estimating the remaining ink amount in the main tank based on the operation of the ink supply valve, so that a user can notice the time to replace the ink more easily.

Further, in the embodiment, in the case of giving an alarm that there is no ink in the main tank, the image forming operation is stopped after finishing the operation in progress, so that unnecessary operation can be eliminated and the ink can be properly replaced.

The present invention is not limited to the above embodiment and various improvements and design changes may be made without departing from the spirit of the invention.

For example, in the embodiment, a serial type ink jet printer is used as the ink jet printer, however, the present invention is not limited thereto. A line type ink jet printer may be used as the ink jet printer. Applying the structure of the present invention to the line printer can obtain high effect of the present invention.

The entire disclosure of Japanese Patent Application No. Tokugan 2004-121520 which was filed on Apr. 16, 2004, including specification, claims, drawings and summary are incorporated herein by reference in its entirety.

What is claimed is:

1. An ink jet printer comprising:

a main tank to store ink;

a recording head to form an image on a recording medium by jetting the ink from a nozzle;

an ink supply path to supply the ink to the recording head from the main tank;

a sub tank to temporarily store the ink supplied from the main tank, the sub tank being provided in the middle of the ink supply path;

an ink supply valve to control to supply or stop supplying the ink from the main tank to the sub tank by an opening or closing the ink supply valve, the ink supply valve being provided between the main tank and the sub tank on the ink supply path; and a control unit to measure a cumulative time in which the ink supply valve becomes an opened state, and estimate a remaining ink amount in the main tank.

2. The printer of claim 1, further comprising a storage unit to store a cumulative opened state time of the ink supply valve, wherein the storage unit is integrally provided with the main tank.

3. The printer of claim 1, wherein the control unit calculates an estimated value of the remaining ink amount from a following equation;

((initial value)−Σ((opened time of the ink supply valve)×(coefficient)).

4. The printer of claim 3, wherein the control unit corrects a time in which the ink supply valve becomes the opened state according to an ambient temperature and accumulates the time, when the estimated value of the remaining ink amount in the main tank is calculated.

5. The printer of claim 3, comprising a plurality of main tanks to store inks with different viscosities, wherein the control unit sets a different coefficient according to a viscosity of each of the inks, when the estimated value of the remaining ink amount in each of the main tanks is calculated.

6. The printer of claim 3, comprising a plurality of main tanks to store inks with different colors and/or color densities, wherein the control unit sets a different coefficient according to a color and/or a color density of each of the inks, when the estimated value of the remaining ink amount in each of the main tanks is calculated.

7. The printer of claim 3, wherein the main tank is provided at a higher position of the sub tank, and the control unit sets a coefficient according to a difference of elevation of the main tank and the sub tank, when the estimated value of the remaining ink amount in the main tank is calculated.

8. The printer of claim 1, further comprising a display unit to display an estimated value of the remaining ink amount in the main tank.

9. The printer of claim 1, wherein the control unit controls to prohibit a head cleaning when an estimated value of the remaining ink amount in the main tank becomes not more than a predetermined value.

10. The printer of claim 1, further comprising an alarm unit to give an alarm that there is no ink in the main tank when an estimated value of the remaining ink amount in the main tank becomes not more than a predetermined value.

11. The printer of claim 10, wherein an image forming operation is stopped after an operation in progress is finished, in a case of giving an alarm that there is no ink in the main tank.

12. The printer of claim 1, further comprising:

an ink empty detection section to detect that there is no ink in the main tank; and an alarm section to give an alarm when the ink empty detection section detects that there is no ink in the main tank, wherein the ink empty detection section and the alarm section are provided to be separate from a structure to estimate the remaining ink amount in the main tank based on an operation of the ink supply valve.

13. The printer of claim 12, wherein an image forming operation is stopped after an operation in progress is finished, in a case of giving an alarm that there is no ink in the main tank.

14. An ink jet printer comprising:

a main tank to store ink;

a recording head to form an image on a recording medium by jetting the ink from a nozzle;

an ink supply path to supply the ink to the recording head from the main tank;

a sub tank to temporarily store the ink supplied from the main tank, the sub tank being provided in the middle of the ink supply path;

an ink supply valve to control to supply or stop supplying the ink from the main tank to the sub tank by an opening or closing the ink supply valve, the ink supply valve being provided between the main tank and the sub tank on the ink supply path; and a control unit to measure a cumulative number of times of an opened state of the ink supply valve, and estimate a remaining ink amount in the main tank.

15. The printer of claim 14, wherein the control unit sets a period of one time in which the ink supply valve becomes the opened state to allow a predetermined ink amount to pass the ink supply valve from a time in which the ink supply valve is opened to a time in which the ink supply valve is closed.

16. The printer of claim 14, wherein the control unit corrects a period of one time in which the ink supply valve becomes the opened state to allow a predetermined ink amount to pass the ink supply valve from a time in which the ink supply valve is opened to a time in which the ink supply valve is closed, in a case where an ambient temperature changes.

17. The printer of claim 14, wherein the control unit calculates an estimated value of the remaining ink amount from a following equation;

((initial value)−Σ((opened time of the ink supply valve)×(coefficient)).

18. The printer of claim 17, comprising a plurality of main tanks to store inks with different viscosities, wherein the control unit sets a different coefficient according to a viscosity of each of the inks, when the estimated value of the remaining ink amount in each of the main tanks is calculated.

19. The printer of claim 17, comprising a plurality of main tanks to store inks with different colors and/or color densities, wherein the control unit sets a different coefficient according to a color and/or a color density of each of the inks, when the estimated value of the remaining ink amount in each of the main tanks is calculated.

20. The printer of claim 17, wherein the main tank is provided at a higher position of the sub tank, and the control unit sets a coefficient according to a difference of elevation of the main tank and the sub tank, when the estimated value of the remaining ink amount in the main tank is calculated.

* * * * *